United States Patent [19]

Lamberty

[11] Patent Number: 4,638,322

[45] Date of Patent: Jan. 20, 1987

[54] MULTIPLE FEED ANTENNA

[75] Inventor: Bernard J. Lamberty, Kent, Wash.

[73] Assignee: The Boeing Company, Seattle, Wash.

[21] Appl. No.: 580,013

[22] Filed: Feb. 14, 1984

[51] Int. Cl.[4] ..... H01Q 03/20

[52] U.S. Cl. ..... 343/761; 343/840

[58] Field of Search ..... 343/761, 839, 840

[56] References Cited

U.S. PATENT DOCUMENTS

| | | | |
|---|---|---|---|
| 1,932,469 | 10/1933 | Leib et al. | 343/839 |
| 2,975,419 | 3/1961 | Brown | 343/839 |
| 3,164,835 | 1/1965 | Alsberg | 343/779 |
| 3,332,083 | 7/1967 | Broussaud | 343/761 |
| 3,534,375 | 10/1970 | Paine | 343/839 |
| 3,633,209 | 1/1972 | Afifi | 343/781 |
| 3,680,141 | 7/1972 | Karikomi | 343/839 |
| 3,696,435 | 10/1972 | Zucker | 343/779 |
| 3,710,341 | 1/1973 | Sciambi, Jr. | 343/779 |
| 3,713,163 | 1/1973 | Keller et al. | 343/754 |
| 3,810,185 | 5/1974 | Wilkinson | 343/756 |
| 3,852,763 | 12/1974 | Kreutel, Jr. et al. | 343/761 |
| 3,916,416 | 10/1975 | Lewis | 343/761 |
| 3,922,682 | 11/1975 | Hyde | 343/761 |
| 3,938,162 | 2/1976 | Schmidt | 343/840 |
| 3,949,404 | 4/1976 | Fletcher et al. | 343/761 |
| 3,988,736 | 10/1976 | Smith et al. | 343/761 |
| 4,258,366 | 3/1981 | Frosch | 343/786 |
| 4,462,034 | 7/1984 | Betsudan et al. | 343/761 |

*Primary Examiner*—Eli Lieberman

*Attorney, Agent, or Firm*—Schwartz, Jeffery, Schwaab, Mack, Blumenthal & Evans

[57] ABSTRACT

The multiple feed antenna comprises a primary focussing element and at least two feeds. The feeds are spaced from each other and have different characteristics such as different frequency bands. The focussing element is moved such that its focal point coincides individually with the feeds. The focussing element may be designed to be offset with respect to its focal axis. In this manner, the antenna may have a common aperture and common boresight for each of the feeds.

9 Claims, 15 Drawing Figures

MULTIPLE FEED ANTENNA

BACKGROUND OF THE INVENTION

1. Field of the invention

The present invention relates to antennas using a single focussing element and a plurality of feeds, and more particularly to such antennas which have a common aperture and a common boresight.

2. Discussion of Related Art

In high performance aircraft and spacecraft applications, space is usually at a premium. Yet modern systems applications frequently call for multiple, large aperture antennas with a common boresight but each having conflicting requirements (e.g. transmit/receive, widely spaced frequency bands, etc.). Consequently, there is a need to find a way to combine apertures without compromising such requirements.

An antenna boresight is defined as the beam maximum direction. For focussed antenna systems, the boresight coincides with the direction of the focal axis. Aperture is defined as the projection of the area of the focussing element on a plane perpendicular to the focal axis.

The problem of co-location and of co-boresighted apertures has been addressed in several ways in the past. Several examples of such apertures are discussed below.

Parabolic reflectors with interchangeable feeds have been suggested. This solution is similar to that of a microscope with a turret having lenses providing several discrete values of magnification. The chief disadvantage of this approach is that there are usually cables or waveguides associated with each feed which must flex or bend when a new feed is positioned to the focus. Flexing can cause phase errors or arcing problems if high power is involved. Furthermore, to minimize loss, transmitters or preamplifiers are frequently mounted on the feed which increases weight and complexity of the movable feed.

Lenses with interchangeable feeds have also been suggested. This approach is similar to the approach using parabolic reflectors with interchangeable feeds and has many of the same problems.

Frequency selective reflectors have been tried. The use of two or more apertures operating at different frequencies permits frequency selective surfaces to be used to conserve space. One example of such a reflector uses a dichroic surface subreflector positioned in front of a parabolic reflector. A first feed, near the parabolic vertex, is in the frequency band where the subreflector is reflective and so operates as a cassegrain system. A second feed is positioned at the parabolic focus and operates in the frequency band where the subreflector is "transparent." The second feed therefore operates as a point focus feed.

Another example of a frequency selective reflector system comprises a plurality of frequency selective reflectors stacked coaxially. A separate feed is directed at each of the reflectors. The first feed reflects off the first reflector, which is a bandpass surface at the frequency bands of the other feeds. Each successive feed reflects off its associated surface, which is a bandpass surface for each of the next successive feeds.

Disadvantages of the frequency selective reflector approach are that losses are associated with each frequency selective surface, particularly when the operating bands of the feeds are closely spaced in frequency. Also, losses increase and bandpass characteristics change as the angle of incidence varies. This approach trades lateral displacement of apertures for coaxial displacement and so is not very conservative of volume.

Other common boresight antennas are known. For example, U.S. Pat. No. 3,534,375 to Paine discloses a common boresight antenna for any one of several feeds. It performs this function by rotating a subreflector in a cassegrain (2 reflector) system. This system suffers from blockage of the aperture by the subreflector. This blockage is at the center of the aperture where its effect on efficiency is most severe. Also, a cassegrain antenna with a tilted subreflector and an offset feed tends to have less aperture efficiency (greater phase error) than when the feed and subreflector are coaxial and symmetrical with the main reflector, where the loss in efficiency depends on the amount of tilt and offset. Although this phase error can be compensated for to some extent in subreflector design, this correction tends to apply over a narrow frequency band.

U.S. Pat. No. 3,696,435 to Zucker discloses an antenna having a single reflector with multiple feeds; however, the feeds are not co-boresighted. Here, each feed is associated with a particular direction. Other limitations include the fact that the feeds are displaced laterally from the parabolic focal axis. Therefore, only one feed can be at the prime focus. All other feeds suffer some measure of scan loss (phase error) depending on the amount of displacement off axis. Feed locations are selected to minimize these errors, but the errors are not eliminated. Also, feed position is a function of frequency as well as lateral displacement. Thus, beam scan by rotating the reflector is not feasible.

SUMMARY OF THE INVENTION

One object of the present invention is to provide an antenna having plural feeds, and a single element for focussing the feeds.

A further object of the invention is to provide a plural feed antenna in which each feed is fixed and independent and so requires no flexing of cables or motion of large complex electronic equipment.

Another object of the present invention is to provide an antenna having multiple feeds wherein no phase distortion occurs due to a change from one feed to another.

One additional object of the present invention is to provide a multiple feed antenna having a common boresight and aperture.

Another object of the present invention is to provide a multiple feed antenna which is light in weight and relatively compact so as to enable its use in a space limited environment.

In accordance with the above and other objects, the present invention is a multiple feed antenna, comprising a focussing element having a focal axis and at least two feeds. The feeds are spaced from each other. A mechanism is provided for rotating the focussing element to a different position for each feed such that each feed is individually positioned on the focal axis of the focussing element and directed at the focussing element.

The focussing element may be a reflector which is an offset axis sector of a paraboloid of revolution. The sector is defined by the intersection of the paraboloid of revolution and a right circular cylinder having an axis parallel to the axis of the paraboloid of revolution.

The rotating mechanism may produce rotation of the reflector about an axis parallel to the axis of the paraboloid of revolution whereby the antenna has a common boresight in each position of the reflector. In another embodiment, the rotating mechanism produces rotation of the reflector about an axis perpendicular to the axis of the paraboloid of revolution whereby the boresight of the antenna is different in each position of the reflector.

In one embodiment, the right circular cylinder is positioned entirely on one side of the axis of the paraboloid of revolution, and the rotating mechanism produces rotation of the reflector about the axis of the right circular cylinder. In this manner, the antenna has a common boresight in each position of the reflector and the feeds are positioned outside the projected aperture area. In another embodiment, the right circular cylinder is positioned to contain the axis of the paraboloid of revolution, and the rotating mechanism produces rotation of the reflector about the axis of the right circular cylinder such that the antenna has a common boresight in each position of the reflector and the feeds are positioned to partially block the projected aperture area.

In place of a reflector, an electromagnetic lens may be used. An advantage of this embodiment of the invention is that feeds are always positioned behind the lens so aperture blockage by the feeds will not be produced. The invention also includes the method of operating a directive antenna comprising a movable focussing element having a focal axis and a plurality of feeds. The method comprises positioning the feeds spaced from one another and rotating the focusing element such that each of the feeds is individually located on the focal line and directed at the focussing element.

BRIEF DESCRIPTION OF THE DRAWINGS

The above and other objects of the invention will become more readily apparent as the invention is more fully understood from the detailed description to follow, reference being had to the accompanying drawings in which like reference numerals represent like parts throughout, and in which.

DETAILED DESCRIPTION OF THE PREFERRED EMBODIMENTS

Figure 1:
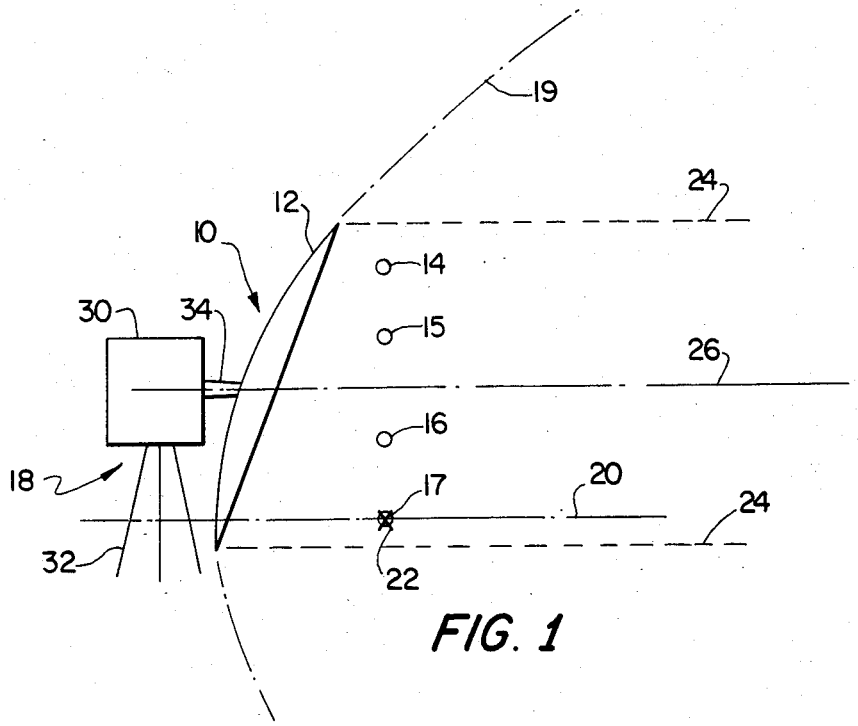
FIG. 1 schematically represents an elevational view of a multiple feed antenna according to the present invention.
Figure 2:
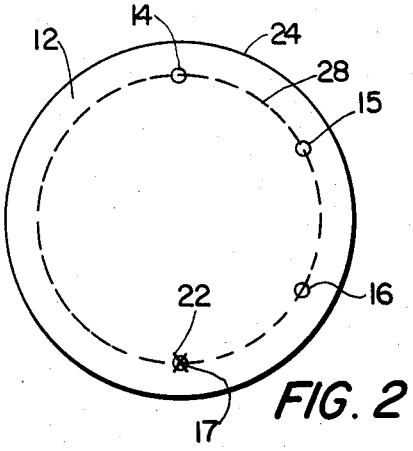
FIG. 2 schematically depicts an end view of the antenna of FIG. 1 in a first feed position.

With reference to FIGS. 1 and 2, the antenna 10 of the present invention will now be described in detail. The antenna 10 comprises a reflector element 12, a plurality of feeds 14 through 17, and a mount 18.

Reflector element 12 is an offset parabolic reflector formed from a section of a paraboloid of revolution indicated by dash-dot line 19. The paraboloid of revolution 19 has a focal axis indicated by dash-dot line 20. The focal axis 20 passes through the vertex of the paraboloid and contains the focal point 22 of the paraboloid indicated by "X" 22. As indicated in FIGS. 1 and 2, feed 17 is located at the focal point 22.

Reflector 12 is an offset sector of paraboloid 19. Accordingly, the center of reflector 12 is spaced from axis 20 of paraboloid 19. By way of example, reflector 12 can be defined by the intersection of paraboloid 19 and a right circular cylinder indicated in the elevational view of FIG. 1 by parallel lines 24. FIG. 2 is an end view of the reflector and, thus, the projection of the reflector 12 is circular in FIG. 2.

Clearly, since feed 17 is positioned directly at focal point 22 in FIGS. 1 and 2, lines of radiation from feed 22 directed to reflector 12 will result in lines of radiation which are all parallel to focal axis 20. Conversely, lines of radiation which are parallel to focal axis 20 and are directed at reflector 12 will converge at feed 17. Feeds 14–17 may be conventional horns or other conventional feeds directed to subtend solid angles with reflector 12. Accordingly, with reflector 12 in the position shown in FIGS. 1 and 2, reflector 12 and feed 17 comprise an antenna having a boresight in the direction of focal axis 26 and having an aperture described by projection of reflector 12 on a plane perpendicular to axis 26.

Figure 3:
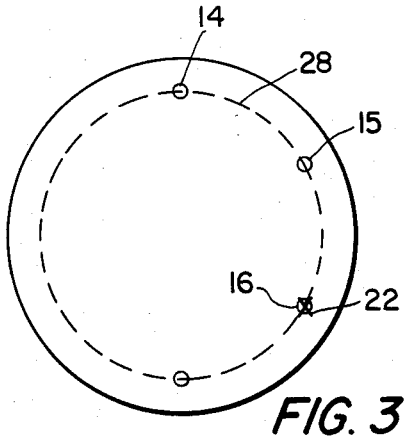
FIG. 3 schematically depicts an end view of the antenna of FIG. 1 rotated to a second feed position.
Figure 4:
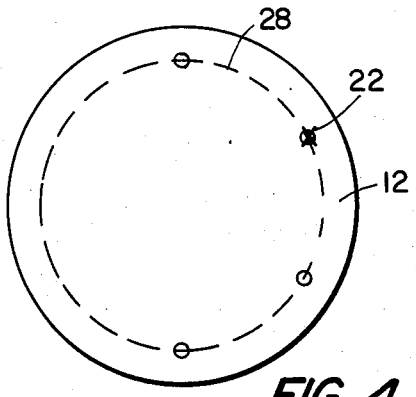
FIG. 4 schematically depicts an end view of the antenna of FIG. 1 rotated to a third feed position.
Figure 5:
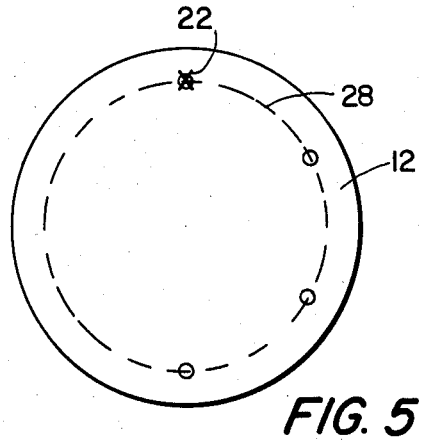
FIG. 5 schematically depicts an end view of the antenna of FIG. 1 rotated to a fourth feed position.

As shown in FIG. 1, cylinder 24 has an axis 26 which is parallel to axis 20 of paraboloid 19. Accordingly, by rotating reflector 12 about axis 26, focal point 22 will describe a circular path, referred to here as focal circle 28, shown in FIG. 2. As shown in FIGS. 2 through 5, feeds 14 through 17 are fixed in position on focal circle 28. Accordingly, if reflector 12 is rotated in a counterclockwise direction, as viewed in FIGS. 2 through 5, about axis 26, focal point 22 will move from its position of coincidence with feed 17 along focal circle 28 and will become coincident successively with feeds 16, 15 and 14, as shown in FIGS. 3, 4 and 5, respectively. As shown in FIG. 1, a motor 30, connected to a motor support structure 32 may rotate reflector 12 through a shaft 34, connected to the point at which axis 26 intersects reflector 12.

Clearly, as reflector 12 is rotated about axis 26, focal axis 20 always remains parallel to axis 26, although changing its position to describe focal circle 28. Consequently, it is clear that the aperture and boresight of reflector 12 combined with, respectively, feeds 14 through 17 always remains the same. By providing each feed 14–17 with a different characteristic, such as, for example, differing frequency bands, a plurality of different antennas can be formed having exactly the same aperture and boresight.

While four feeds are shown in the drawings, it should be clear from the foregoing description that any reasonable number of feeds can be used, depending on the necessary number of differing antenna applications.

Motor 30 could be servo controlled to automatically position reflector 12 in each position. It should be noted that reflector 12 may be relatively light and, thus, a relatively low horsepower motor is required for its rotation. As shown, motor 30 is connected through shaft 34 to the center of reflector 12. Of course, other possible connections are also feasible, as would be apparent to one of ordinary skill in the art.

The size of reflector 12 would depend on the application in which the antenna is being used. If maximum gain and minimum beamwidth are desired, reflector 12 may be designed to fill all available space. It should be noted, however, that when the sector of paraboloid 19 which is occupied by reflector 12 overlaps the paraboloid axis 20, as is the case in FIGS. 1 through 5, focal circle 28 is contained completely within the antenna aperture defined by cylinder 24. Accordingly, the aperture is partially blocked by the feeds in the focal circle. However, this blockage occurs at the edge of the aperture where field intensity is usually low, so that blockage effects are small.

Figure 6:
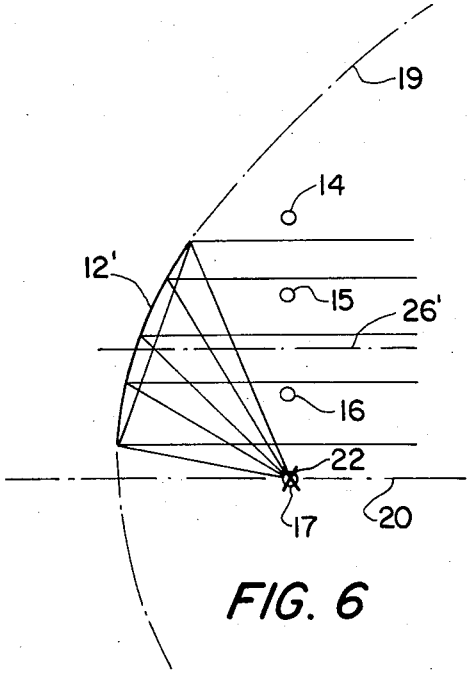
FIG. 6 schematically depicts an elevational view of a second embodiment of the antenna according to the present invention.
Figure 6A:
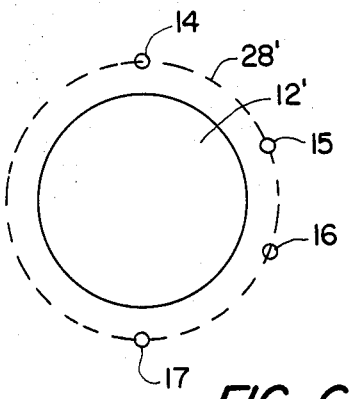
FIG. 6A schematically depicts an end elevational view of the antenna of FIG. 6.

If it is desired for a particular application to avoid any blockage of the aperture, a reflector 12', as shown in FIGS. 6 and 6A, may be used. As with reflector 12, reflector 12' is a sector of paraboloid 19 defined by the intersection of a right circular cylinder with paraboloid 19. However, this intersection is such that reflector 12' is formed entirely on one side of focal axis 20 of paraboloid 19. Accordingly, it can be seen that the rays, indicated by solid lines in FIG. 6, which are directed from feed 17 to reflector 12' result in parallel rays which completely miss feed 17. It will also be apparent that the focal circle 28' for reflector 12' is therefore completely outside of the aperture of reflector 12' and, accordingly feeds 14 through 16 are similarly outside of the aperture.

Figure 7:
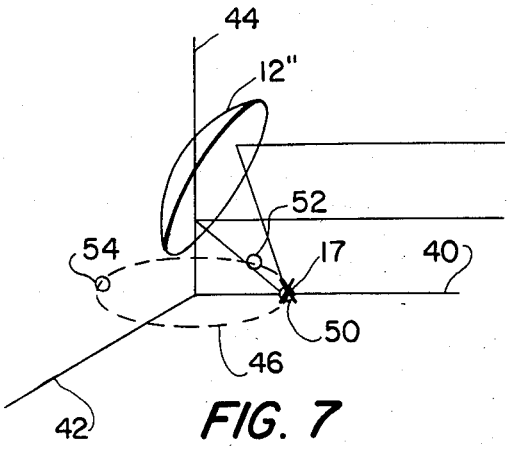
FIG. 7 is a schematic 3-dimensional representation of the antenna of the present invention with a perpendicular rotation axis.
Figure 7A:
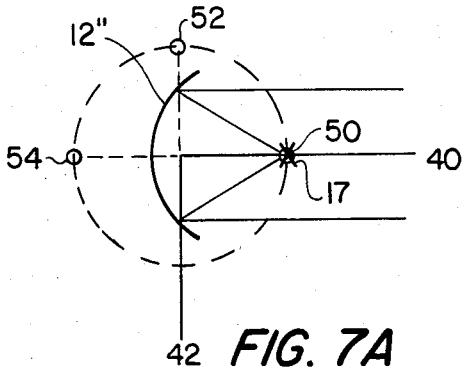
FIG. 7A is a top plan view of the antenna of FIG. 7.
Figure 8:
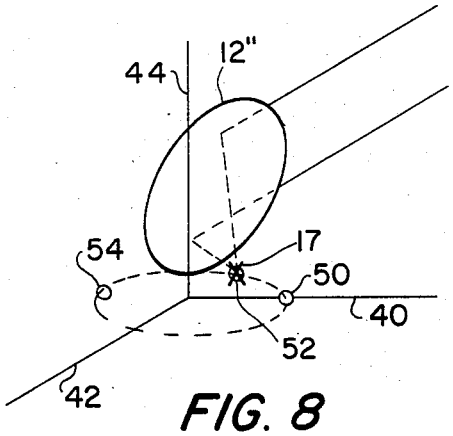
FIG. 8 schematically depicts the antenna of FIG. 7 rotated to a second feed position.
Figure 8A:
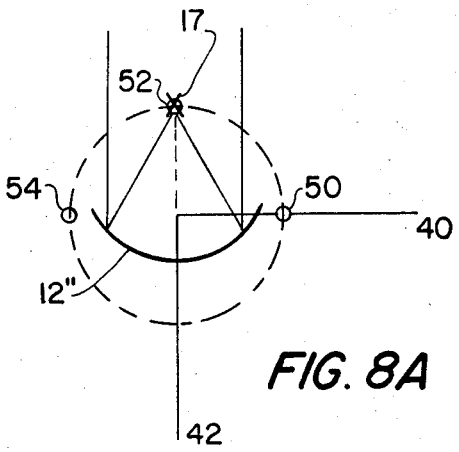
FIG. 8A is a top plan view of the antenna of FIG. 8.
Figure 9:
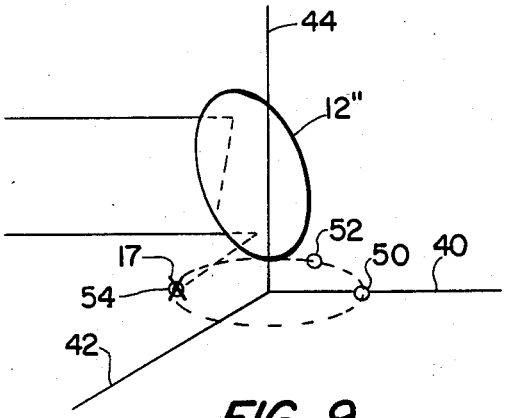
FIG. 9 schematically depicts the antenna of FIG. 7 rotated to a third feed position.
Figure 9A:
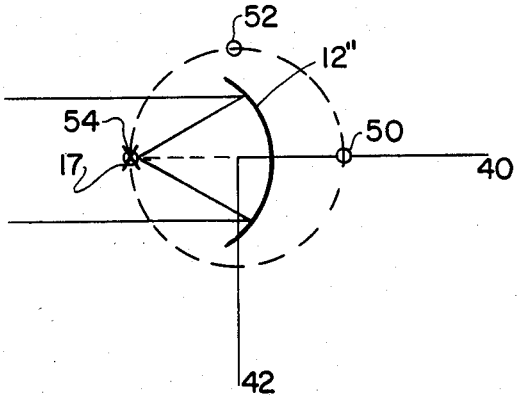
FIG. 9A is a top plan view of the antenna of FIG. 9.

As will be understood from the foregoing discussions, the antennas of FIGS. 1 and 6 are common aperture, common boresight antennas which can be confined to very limited space and are able to utilize any one of a plurality of feeds without the necessity of phase compensation. Absolutely no adjustment or movement of the feeds 14 through 17 is necessary. Simply by rotating the reflector 12 or 12', various antenna characteristics can be achieved simply and economically. However, applications may occur where it is desirable to have a plurality of boresight directions. In this case, the embodiment of FIGS. 7 through 9A can be used. FIGS. 7 through 9A show a reflector 12'' in a left handed 3-dimensional coordinate system having X axis 40, Y axis 42 and Z axis 44. In FIGS. 7 and 7A, X axis 40 is the focal axis of the paraboloid of which reflector 12'' is a sector. Accordingly, the position of reflector 12'' in FIGS. 7 and 7A corresponds to the position of reflector 12 in FIGS. 6 and 6A. However, in FIGS. 7 and 7A, reflector 12'' is to be rotated about Z axis 44 which is perpendicular to the focal axis of the paraboloid. Accordingly, the focal circle 46 is defined in the X-Y plane as reflector 12'' is rotated. Accordingly, the parallel rays to or from reflector 12'', shown in solid lines, are always parallel to the X-Y plane, but revolve around the Z axis. FIGS. 7 and 7A show the orientation of reflector 12'' when focal point 17 is coincident with the first feed 50, and the boresight of reflector 12'' is in the +X direction. FIGS. 8 and 8A show the case where reflector 12'' has been rotated such that focal point 17 is coincident with a second feed 52 and the boresight is in approximately the −Y direction. FIGS. 9 and 9A show the situation where reflector 12'' has been rotated such that focal point 17 is coincident with feed 54 and the boresight is in approximately the −X direction. Of course, additional feeds could be added, as desired. It is also possible to rotate the reflector 12'' about several different axes. For example, a focal circle similar to that of FIGS. 6 and 6A could be defined in each of the directions shown in FIGS. 7, 7A, 8, 8A, 9 and 9A. In this case, reflector 12'' could be rotated about an axis parallel to its boresight in each direction X, −Y and −X to provide a plurality of feeds in each such direction.

In FIGS. 1–9A, it has been assumed that reflectors 12, 12' and 12'' are sectors of similar paraboloids. Therefore, even though these reflectors may be different sectors, they have the same focal point 17. Of course, if a different paraboloid is used, the focal point would vary.

Figure 10:
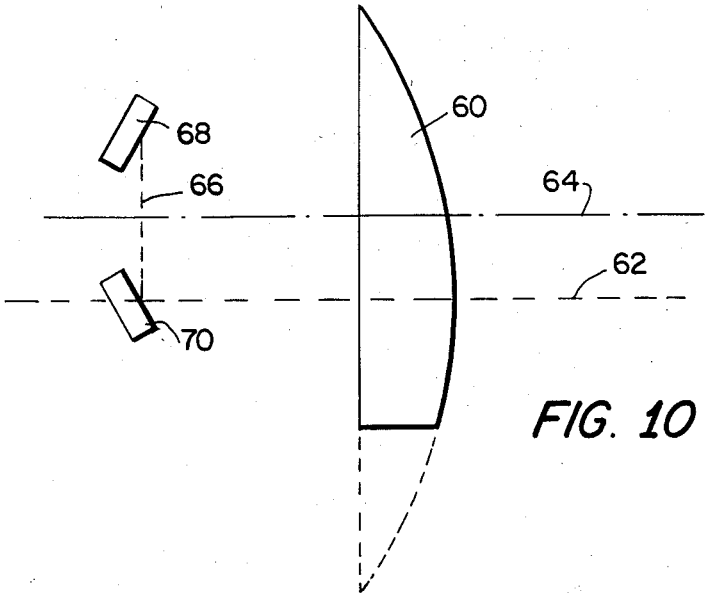
FIG. 10 schematically depicts an elevational view of an embodiment of the antenna of the present invention utilizing an electromagnetic lens.
Figure 11:
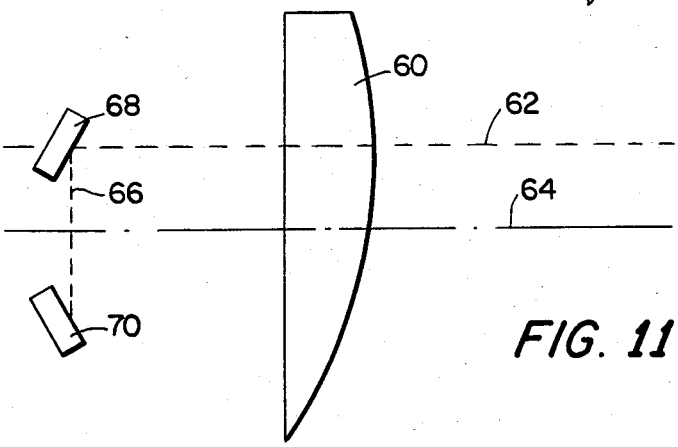
FIG. 11 schematically depicts an elevational view of the antenna of FIG. 10 rotated to a second feed position.

FIGS. 10 and 11 show an embodiment of the invention where an electromagnetic lens 60 is used in place of a reflector. Lens 60 has a focal axis indicated by dotted line 62. Lens 60 is asymmetrical and is rotated about an axis of rotation indicated by dash-dot line 64. Accordingly, as the lens 60 is rotated about axis 64, the focal axis 62 describes a focal circle indicated by dotted line 66. Two feeds 68 and 70 are shown with their phase centers positioned on the focal circle. In the position shown in FIG. 10, focal axis 62 passes through the phase center of feed 70. In FIG. 11, the lens 60 is shown in a second position where it has been rotated about rotation axis 64 to a position where the focal axis 62 passes through the phase center of feed 68. Accordingly, it can be seen that the embodiment of FIGS. 10 and 11 is equivalent to the embodiment using reflectors for the antenna focussing element. That is, by simply rotating lens 60, different antenna characteristics can be achieved by causing the lens focal axis to pass through a feed element having the desired antenna characteristics.

It will be noted that axis of rotation 64 is positioned in the center of asymmetrical lens 60, as viewed in FIGS. 10 and 11. In this manner, when lens 60 is rotated, the aperture and boresight of the antenna remain the same. In this embodiment, since the lens is not symmetrical, feeds 68 and 70 are directed so as to subtend a solid angle which includes the asymmetrical lens 60. In this manner, a common aperture, common boresight multiple feed antenna is provided. Of course, as with the embodiment of the reflector 12'' shown in FIGS. 7 through 9A, lens 60 could also be rotated about an axis which is perpendicular to the focal axis so as to define differing boresights.

The advantage of the use of a lens in place of a reflector is that the lens can be made to fill all of the available space and the feeds will not obstruct the aperture in any way. However, an electromagnetic lens is generally heavier than a reflector and therefore the reflector version of the invention is preferrable unless excessive blockage of the aperture results. In both versions, all feeds are fixed on the focal circle so that no feed motion is required.

The foregoing examples are provided for purposes of illustrating the invention, but are not deemed to be limitative thereof. Clearly, numerous additions, changes or other modifications could be made without departing from the scope of the invention, as set forth in the appended claims.

What is claimed is:

1. A multiple feed antenna, comprising:

a primary focussing element having a focal axis;

at least two feeds, said feeds being spaced from each other;

means for moving said primary focussing element to a different position for each said feed such that each of said feeds is individually positioned on said focal axis; and wherein said moving means produces rotation of said focussing element about an axis parallel to said focal axis such that said antenna has a common boresight in each of said different positions of said focussing element.

2. A multiple feed antenna as set forth in claim 1 wherein said focussing element is a reflector which has a shape of an off axis sector of a paraboloid of revolution having a focal point on said focal axis, and said moving means moves said reflector such that each of said feeds is individually positioned at said focal point.

3. A multiple feed antenna as set forth in claim 2 wherein said reflector is defined by the intersection of said paraboloid of revolution and a right circular cylinder having an axis parallel to said focal axis of said paraboloid of revolution.

4. A multiple feed antenna as set forth in claim 2 wherein said sector is positioned entirely on one side of said focal axis of said paraboloid of revolution, and said moving means produces rotation of said reflector about an axis parallel to said focal axis such that said antenna has a common boresight in each of said different positions of said reflector and said feeds are positioned outside the projected aperture of said reflector.

5. A multiple feed antenna as set forth in claim 2 wherein said sector is positioned to contain the focal axis of said paraboloid of revolution, and said feeds are positioned to partially block the projected aperture of said reflector.

6. A multiple feed antenna as set forth in claim 1 including at least 3 feeds.

7. A method of operating a directive antenna having a primary focussing element which comprises an off axis sector of a paraboloid of revolution having a focal point and a focal axis and a plurality of feeds for said element, said method comprising the steps of:

positioning said feeds spaced from one another;

moving said primary focussing element such that each of said feeds is individually located at said focal point and directed to said focussing element; and wherein said moving step comprises rotating said antenna about an axis parallel to the axis of said paraboloid of revolution.

8. A method as set forth in claim 7 wherein said positioning step includes positioning said feeds such that said antenna has a common boresight in each position of said focussing element as said focussing element is moved.

9. A method as set forth in claim 7 wherein said method further includes the step of forming said focussing element by the intersection of said paraboloid of revolution with a right circular cylinder having an axis parallel to the axis of said paraboloid of revolution.

* * * * *